US008484863B2

(12) United States Patent
Doerer et al.

(10) Patent No.: US 8,484,863 B2
(45) Date of Patent: Jul. 16, 2013

(54) TOP LIFT ASSEMBLY FOR A SHOE HEEL

(75) Inventors: Daniel M. Doerer, Town & Country, MO (US); Duane Shelton, Bourbon, MO (US)

(73) Assignee: Brown Shoe Company, Inc., St. Louis, MO (US)

( * ) Notice: Subject to any disclaimer, the term of this patent is extended or adjusted under 35 U.S.C. 154(b) by 502 days.

(21) Appl. No.: 12/774,130

(22) Filed: May 5, 2010

(65) Prior Publication Data

US 2010/0281717 A1 Nov. 11, 2010

Related U.S. Application Data

(60) Provisional application No. 61/176,180, filed on May 7, 2009.

(51) Int. Cl.
*A43B 21/20* (2006.01)

(52) U.S. Cl.
USPC ..... 36/34 A; 36/35 A

(58) Field of Classification Search
USPC ..... 36/34 A, 35 A, 34 R
See application file for complete search history.

(56) References Cited

U.S. PATENT DOCUMENTS 3,119,192 A * 1/1964 Ronci ..... 36/34 A
5,325,612 A * 7/1994 Lock et al. ..... 36/34 R

FOREIGN PATENT DOCUMENTS

EP 0388366 A3 9/1990
EP 0419317 B1 3/1991
EP 0573717 A1 12/1993
WO 9112741 A1 9/1991

* cited by examiner

*Primary Examiner* — Ted Kavanaugh
(74) *Attorney, Agent, or Firm* — Husch Blackwell LLP

(57) ABSTRACT

A dowelled top lift assembly for a shoe heel including an anchor member affixed or molded to a dowel pin member and a top lift member for contacting the walking surface affixed, molded to and encapsulating the anchor member. The anchor member is made of a harder material as compared to the top lift member, the anchor member being made of a hard thermoplastic material and the top lift member being made of a softer thermoplastic material such as a thermoset polyurethane elastomer or a softer thermoplastic polyurethane. The anchor member may include one or more ridges for cooperatively engaging grooves associated with the head portion of the dowel pin member.

7 Claims, 4 Drawing Sheets

TOP LIFT ASSEMBLY FOR A SHOE HEEL

CROSS-REFERENCE TO RELATED APPLICATION

This application claims the benefit of priority to U.S. Provisional Patent Application Ser. No. 61/176,180, filed on May 7, 2009, entitled A TOP LIFT ASSEMBLY FOR A SHOE HEEL, which application is hereby incorporated by reference to the extent permitted by law.

BACKGROUND OF THE INVENTION

The present invention relates generally to a top lift assembly for a shoe heel and, more particularly, to a dowelled top lift assembly for a shoe with a high heel having an anchor member made of a first harder material and a top lift member made of a second softer material.

A shoe top lift assembly is the bottom-most part of a shoe's heel which comes into contact with the ground during walking. A top lift assembly can be used on a wide variety of shoes and includes a top lift member having a bottom surface which comes into contact with the ground surface. A dowelled top lift assembly is an assembly used typically on women's shoes having an elevated heel. The dowelled top lift assembly is molded around a pin or dowel which projects upwardly from the assembly and is attached or otherwise driven into the bottom of the heel of the shoe.

The top lift members typically wear out fast and then the shoes are either thrown away or taken to a shoe repair shop for replacement of the top lift members. For the comfort and safety of the wearer, the top lift assembly should be both firmly and reliably retained in a shoe heel and should also exhibit good cushioning and non-slip characteristics. In other words, the top lift assembly should provide firm support to retain control and prevent injuries.

Prior art dowelled top lift assemblies are constructed from a metal dowel and a material having a single hardness, typically a hard thermoplastic material. However, the prior art dowelled top lift assemblies made totally from a single hard thermoplastic material have inferior non-slip characteristics and such inferior non-slip characteristics can result in accidents with injury to the user. On the other hand, dowelled top lift assemblies made totally from a single soft material cannot retain the dowel pin in a secure manner because soft materials do not adhere well to the metal dowel and such inferior joinder can cause undesired disengagement of the metal dowel from the heel. Such disengagement can also result in accidents with injury to the user.

Thus, it would be desirable to provide an improved dowelled top lift assembly which promotes secure adhesion between the top lift member and a dowel pin.

It would also be desirable to provide a dowelled top lift assembly for a shoe which has improved non-slip characteristics and enhanced cushioning.

SUMMARY OF THE INVENTION

The present invention is directed to a dowelled top lift assembly which provides a combination of secure attachment to the shoe heel and improved non-slip characteristics. The present invention provides a dowelled top lift assembly having an anchor member of hard thermoplastic material affixed or molded to a dowel pin and a top lift member of a softer thermoplastic material for contacting the walking surface. The anchor member and the top lift member are secured together by a suitable means such as injection molding. The anchor member and the top lift member are further secured by molding the top lift member so that it encompasses the anchor member to be totally embedded in the top lift member.

In one aspect of the present invention, the present invention provides a dowelled top lift assembly having two portions, namely, an anchor member and a top lift member. The anchor member, which adheres to the dowel pin and is attached to the top lift member, is made of a harder material. The harder material can be a rigid, injection moldable thermoplastic elastomer. The top lift member, which contacts the walking surface in use, is made of a softer material such as a thermoset polyurethane elastomer or a softer thermoplastic polyurethane. The anchor member and top lift member are molded together, the anchor member embedded within the top lift member, to form a dowelled top lift assembly.

In accordance with the present invention, because the anchor member is made of a harder material, it adheres better to a metal dowel pin as compared to an anchor member made of a softer material. In contrast, because the top lift member contacts the walking surface, a top lift member made of a softer material as compared to a harder material has better non-slip characteristics and provides better cushioning during walking. The combination of the anchor member and top lift member results in a unitary dowelled top lift assembly with improved performance characteristics.

Specific advantages and features of the present assembly will be apparent from the accompanying drawings and the description of several illustrative embodiments of the present invention.

It should be understood that the present drawings are not necessarily to scale and that the embodiments disclosed herein are sometimes illustrated by fragmentary views. In certain instances, details which are not necessary for an understanding of the present invention or which render other details difficult to perceive may have been omitted. It should also be understood that the invention is not necessarily limited to the particular embodiments illustrated herein. Like numbers utilized throughout the various figures designate like or similar parts or structure.

DETAILED DESCRIPTION

Figure 1:
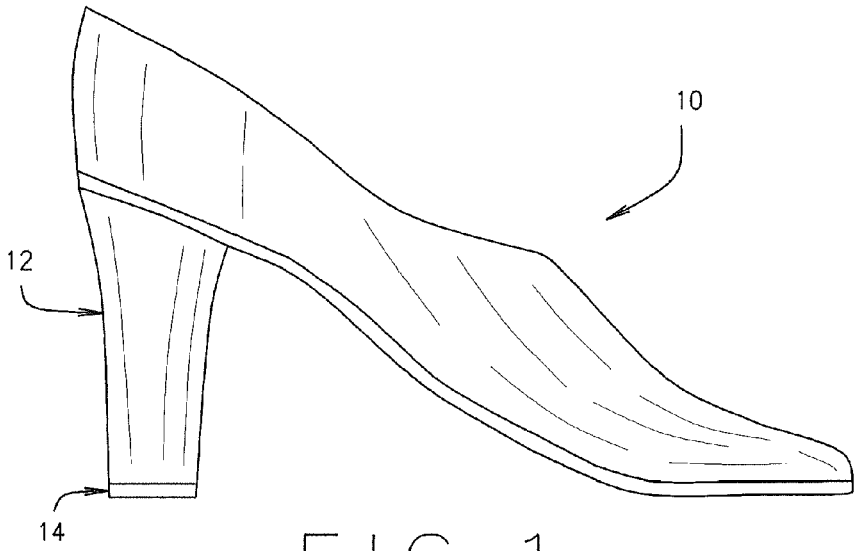
FIG. 1 is a side elevational view of one embodiment of a shoe with a dowelled top lift assembly constructed in accordance with the teachings of the present invention.
Figure 2:
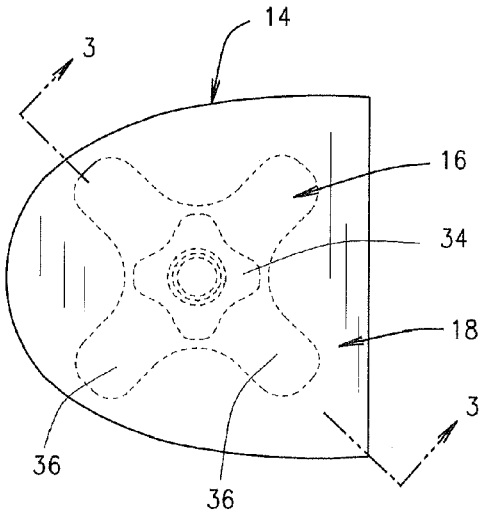
FIG. 2 is a fragmentary, sectional bottom view of the heel portion of the shoe of FIG. 1 showing the present dowelled top lift assembly in its assembled condition.
Figure 3:
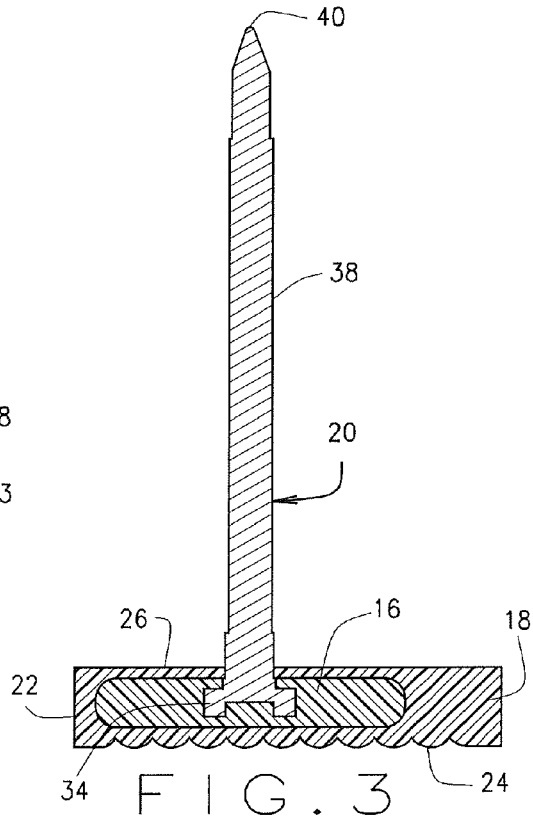
FIG. 3 is a fragmentary cross-sectional view of the present dowelled top lift assembly taken along line 3-3 of FIG. 2.
Figure 4:
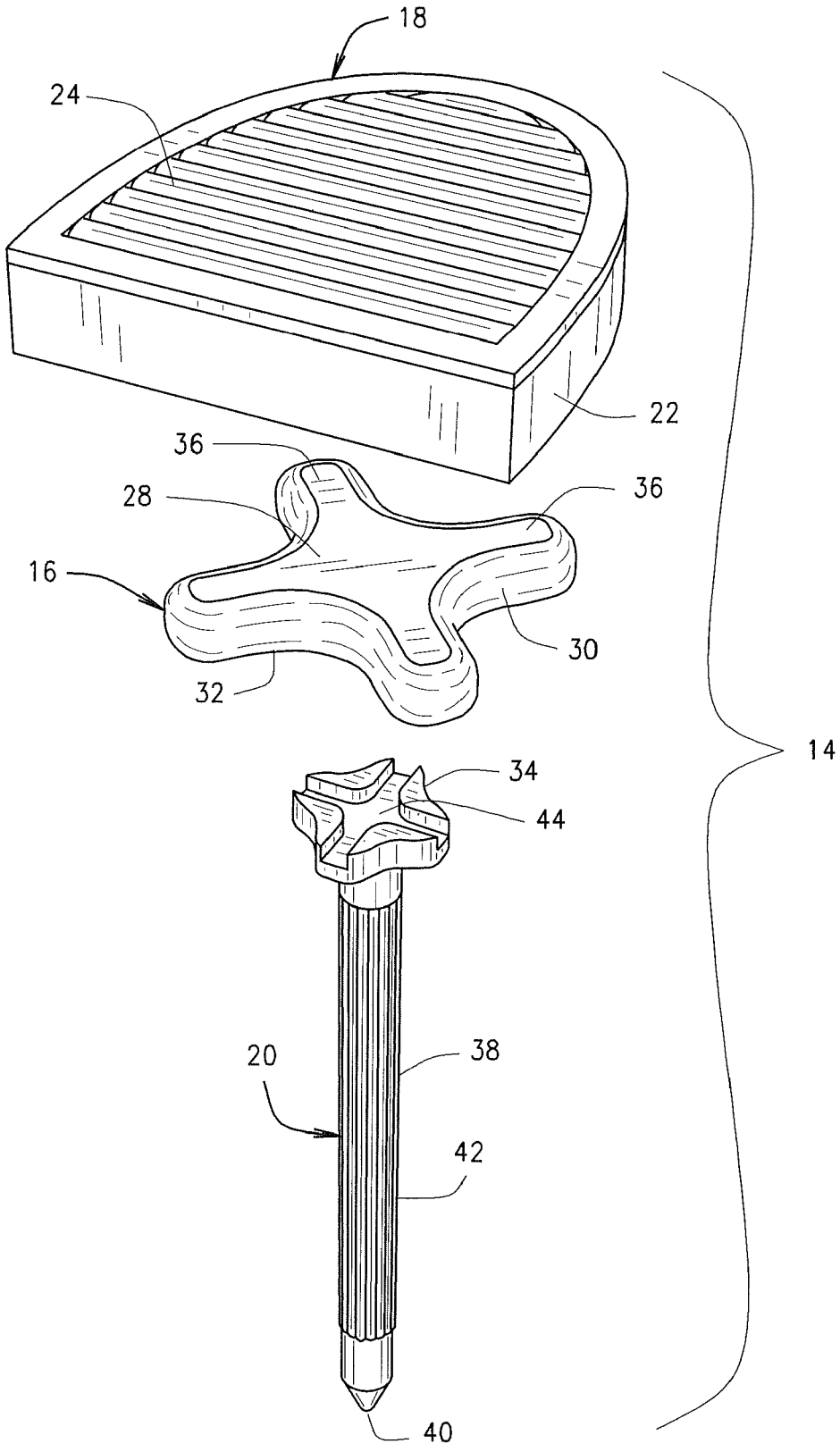
FIG. 4 is an exploded perspective view of the dowelled top lift assembly of FIG. 2.

FIG. 1 illustrates a side elevational view of a shoe 10 constructed in accordance with one embodiment of the present invention. The shoe 10 includes a heel 12 with a dowelled top lift assembly 14 located at the bottom of the heel 12. As illustrated in FIGS. 2-4, one embodiment of the present invention includes a dowelled top lift assembly 14 which generally includes an anchor member 16, a top lift member 18 and a dowel pin member 20. The top lift member 18 includes an outer perimeter 22, a bottom surface 24 and a top surface 26 to which the shoe heel 12 is secured. The bottom surface 24 contacts the walking surface and is subject to maximum wear. The top lift member 18 is made of a soft elastomer material that can be either a thermosetting or thermoplastic type material. Such materials are well known in the art of shoe top lift members and can include, but are not limited to, elastomers such as a softer thermoset polyurethane elastomer or a softer thermoplastic polyurethane. In a preferred embodiment, the Shore A Hardness value of the material for the top lift member 18 is about 75. The top lift member 18 can be made from other materials, however, such additional materials must be softer than the material used for anchor member 16. The Shore A Hardness value for the top lift member 18 can be in the range from about 75 to about 85. The thickness or height of the top lift member 18 is generally about 9-10 millimeter, although such height can vary to conform to the shape of the shoe.

The anchor member 16 includes a bottom surface 28, a side wall 30 and a top surface 32 to which the dowel pin member 20 is secured. The anchor member 16 is molded around the lower portion of the dowel pin member 20, specifically around a head portion or head flange 34 as best illustrated in FIG. 4. The anchor member 16 completely surrounds the head flange 34. The bottom surface 28, the side wall surface 30, and the top surface 32, of the anchor member 16 are embedded in the top lift member 18. The anchor member 16 includes a peripheral shape 30 designed to conform to the size and shape of the head flange 34 of the dowel pin member 20, but those skilled in the art will appreciate that alternate configurations can be used without departing from the spirit and scope of the invention. In one embodiment, the anchor member 16 includes four spider-like arms 36, each arm 36 extending radially outwardly from the center thereof to conform to the shape of the head flange 34. The top surface 32 of the anchor member 16 includes molded ridges (not shown) which are cooperatively engageable with the grooves 44 formed on the surface of the head flange 34 so as to improve the mechanical adhesion and attachment of the dowel pin member 20 to the anchor member 16. This interlocking ridge/groove construction forms a close, tight fit between the members 16 and 34 and provides a mechanical lock therebetween as well. Improving the adherence of the anchor member 16 to the dowel pin member 20, by encapsulation, allows one to use a somewhat softer material for the top lift member 18. The anchor member 16 is made of a hard material. Such materials are well known in the art and can include, but are not limited to, rigid synthetic plastics and injection moldable thermoplastic elastomers. In a preferred embodiment, the Shore A Hardness value of the material for the anchor member 16 is about 90. The thickness or height of the anchor member 16 is generally about 4-5 millimeters. The present construction provides for the securing of the anchor member 16 to the head portion 34 of the dowel pin member 20 so that the durability of the top lift member 18 is enhanced substantially by the improved mechanical lock therebetween.

The dowel pin member 20 includes a head portion 34 and an elongated shaft 38 having a blunt upper end portion 40 which facilitates insertion of the shaft 38 into a sleeve (not shown) contained within the shoe heel 12. The head portion 34 is integrally connected to the lower end of the shaft 38. The elongated shaft 38 includes a plurality of circumferentially spaced axial or longitudinal ridges 42 formed on the outer surface of the shaft 38, which ridges 42 extend from the head flange 34 upwardly over at least a portion, and preferably the greater portion, of the length of the shaft 38 towards its upper end 40 which is conveniently tapered to facilitate its entry into the usual preformed sleeve or recess associated with heel 12. The ridges 42 are formed along the shaft 38 to provide an effective gripping interaction between the shaft 38 and the heel sleeve when the dowel pin member 20 is inserted therewithin.

In another embodiment, the dowel pin member 20 includes the elongated shaft 38 and a pointed upper end 40 which can be inserted directly into a pre-drilled hole (not shown) in the shoe rather than into a sleeve. The pre-drilled hole can either extend partially into or totally through the shoe heel 12.

Figure 5:
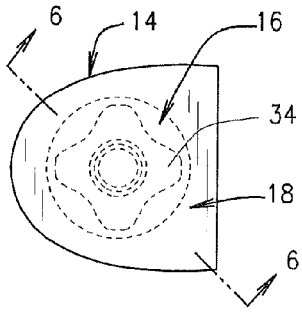
FIG. 5 is a fragmentary, sectional bottom view of another embodiment of the present dowelled top lift assembly shown in its assembled condition.
Figure 6:
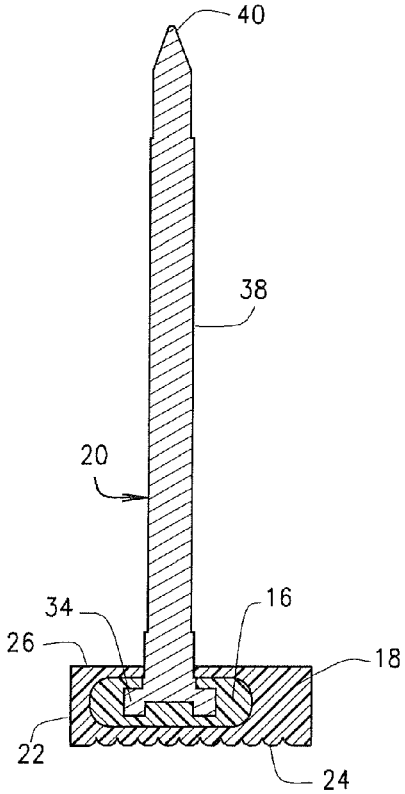
FIG. 6 is a fragmentary cross-sectional view of the present dowelled top lift assembly taken along line 6-6 of FIG. 5.
Figure 7:
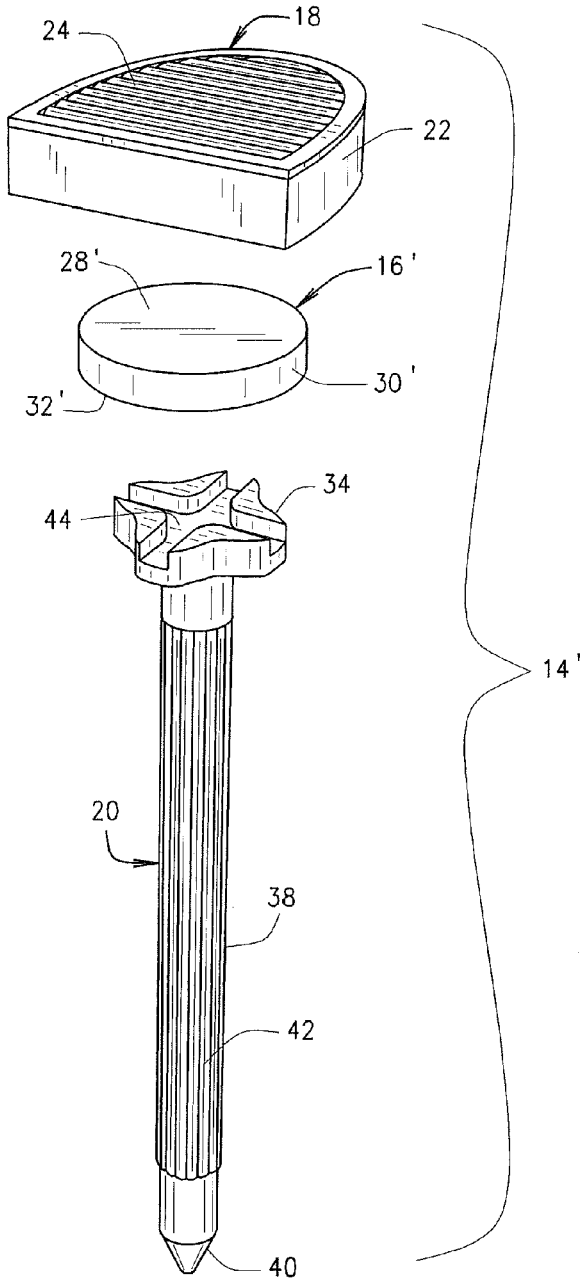
FIG. 7 is an exploded perspective view of the dowelled top lift assembly of FIG. 5.

FIGS. 5-7 illustrate another embodiment 14' of the present dowelled top lift assembly including an anchor member 16', top lift member 18, and a dowel pin member 20. The top lift assembly 14' is substantially identical to top lift assembly 14 except for the shape and construction of the anchor member 16'. In the embodiment illustrated in FIGS. 5-7, the anchor member 16' has a cylindrical shape and includes a bottom surface 28', a cylindrical side wall 30' and a top surface 32' which is secured to the dowel pin member 20 as previously explained. In all other respects, the construction of the top lift member 18 as well as the dowel pin member 20 including the head portion 34 is substantially identical to the construction of the top lift member and dowel pin member associated with top lift assembly 14 illustrated in FIGS. 1-4 and like numerals refer to like parts. The bottom surface 28' of the anchor member 16' is likewise secured to the top surface 26 of the top lift member 18 as previously explained. Like anchor member 16, anchor member 16' may likewise include a plurality of ridges (not shown) associated with its top surface 32' for cooperatively engaging the grooves 44 associated with the upper surface of head portion 34. Still further, it is recognized and anticipated that the shape and construction of the anchor member 16' may likewise take on still additional sizes and shapes so long as such anchor member is compatible for attaching to the head flange 34 and the top lift member 18 as previously explained.

Figure 8:
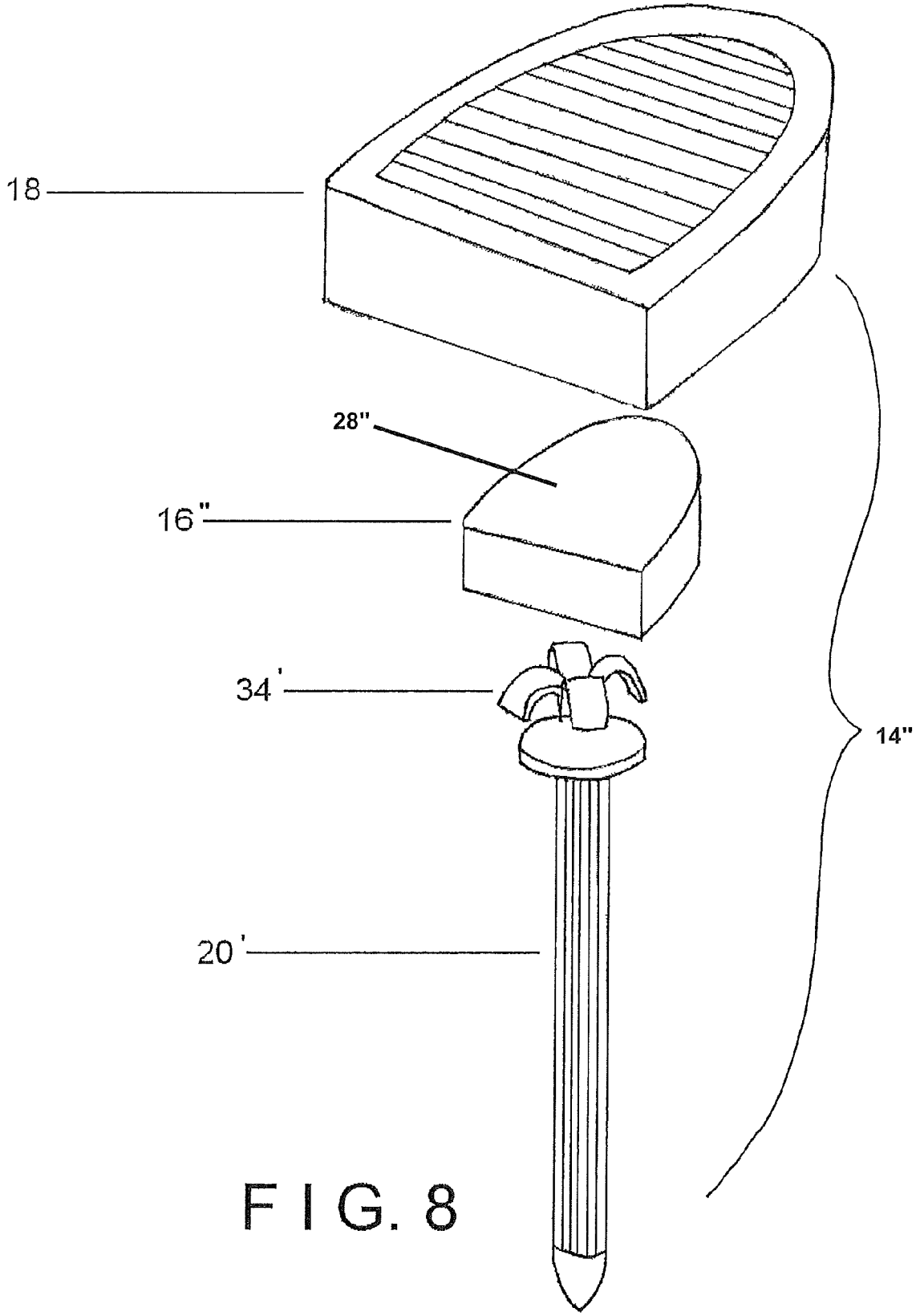
FIG. 8 is an exploded perspective view of another embodiment of the present dowelled top lift assembly.

FIG. 8 illustrates another embodiment 14" of the present dowelled top lift assembly including an anchor member 16", top lift member 18, and a dowel pin member 20'. The top lift assembly 14" is substantially identical to the top lift assembly 14 or top lift assembly 14' except for the shape and construction of the dowel pin member 20'. In the embodiment illustrated in FIG. 8, the dowel pin member 20' forms the body part of outwardly flaring portion 48 on the top surface of the head portion 34' to improve the mechanical adhesion and attachment of the dowel pin member 20' to the anchor member 16". In all other respects, the construction of the top lift member 18 as well as the anchor member 16" is substantially identical to the construction of the top lift member and anchor member associated with top lift assembly 14 or top lift assembly 14' illustrated in FIGS. 1-7 and like numerals refer to like parts.

FIGS. 3 and 6 illustrate enlarged cross-sectional views of the various embodiments of the present dowelled top lift assembly. Both dowelled top lift assembly 14 and dowelled top lift assembly 14' include a metal dowel pin member 20, an anchor member 16 or 16' secured to the dowel pin member 20 and a top lift member 18 bonded to the anchor member 16 or 16' with the bottom surface 24 of the top lift member 18 contacting the walking surface. The bottom surface 24 of the top lift member 18 typically includes transverse molded ridges and/or grooves or other design configurations to enhance the non-slip properties of the top lift member 18 as illustrated in FIGS. 3, 4, 6, 7 and 8. The rigid anchor member

16, 16' or 16" along with the softer top lift member 18 are portions of the unitary dowelled top lift assembly 14, 14' or 14" and are molded together by a suitable molding method such as by injection molding. After the dowel pin member 20 is bonded to the anchor member 16, 16' or 16", the bonded portions are removed from a first mold and then bonded to, or encapsulated by, the top lift member 18 in a second mold. The bottom surface 28, 28' or 28" of the anchor member 16, 16' or 16" is securely molded into the top lift member 18. In another embodiment, one can apply a suitable adhesive to the anchor member 16, 16' or 16" to complete the joinder.

The construction of the present invention provides for the securing of the top lift member 18 to the dowel pin member 20 with the anchor member 16, 16' or 16" positioned therebetween so that the durability of the top lift member is enhanced by the presence of the anchor member being made of a hard material and its anti-slip properties are enhanced by the presence of the top lift portion 18 being made of a softer material. The present dowelled top lift assemblies 14, 14' or 14" have better wear characteristics and non-slip characteristics as compared to the conventional construction.

Thus, there has been shown and described several embodiments of a novel top lift assembly. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A dowelled top lift assembly comprising:

an anchor member including a plurality of arms extending radially outwardly from the center of the anchor member;

a dowel pin member having a head portion and an elongated shaft extending therefrom, said head portion being affixed to said anchor member; and a top lift member having a surface for contacting a walking surface, the head portion of said top lift member being coupled to said anchor member, wherein said anchor member and said top lift member are made from materials having a different hardness, said anchor member being of a material which is harder than the material forming said top lift member.

2. The dowelled top lift assembly of claim 1 wherein the Shore A Hardness value of the material for the anchor member is about 90.

3. The dowelled top lift assembly of claim 1 wherein the Shore A Hardness value of the material for the top lift member is in the range from about 75 to about 85.

4. The dowelled top lift assembly of claim 1 wherein said top lift member is about 9-10 millimeters in vertical height.

5. The dowelled top lift assembly of claim 1 wherein said anchor member is about 4-5 millimeters in vertical height.

6. The dowelled top lift assembly of claim 1 wherein the elongated shaft of said dowel pin member includes at least one longitudinally extending ridge.

7. The dowelled top lift assembly of claim 1 wherein said anchor member includes at least one ridge for cooperatively engaging a corresponding groove associated with the head portion of said dowel pin member, and said anchor member is fully encapsulated by said top lift member.

* * * * *